US006447196B1

(12) United States Patent
Arkwright

(10) Patent No.: US 6,447,196 B1
(45) Date of Patent: Sep. 10, 2002

(54) ADHESIVE FASTENER ASSEMBLY

(76) Inventor: George A. Arkwright, 9105 Chickawane Ct., Alexandria, VA (US) 22309

( * ) Notice: Subject to any disclaimer, the term of this patent is extended or adjusted under 35 U.S.C. 154(b) by 0 days.

(21) Appl. No.: 09/494,250

(22) Filed: Jan. 31, 2000

Related U.S. Application Data

(63) Continuation-in-part of application No. 09/095,695, filed on Jun. 11, 1998, now abandoned, which is a continuation-in-part of application No. 08/521,538, filed on Aug. 30, 1995, now abandoned, and a continuation-in-part of application No. 08/389,677, filed on Feb. 14, 1995, now abandoned, which is a continuation-in-part of application No. 08/174,325, filed on Dec. 30, 1993, now abandoned, which is a continuation-in-part of application No. 08/162,875, filed on Dec. 8, 1993, now abandoned, and a continuation-in-part of application No. 08/162,844, filed on Dec. 7, 1993, now abandoned, and a continuation-in-part of application No. 08/099,458, filed on Jul. 30, 1993, now abandoned, which is a continuation-in-part of application No. 08/059,374, filed on May 12, 1993, now abandoned.

(51) Int. Cl.[7] ..... B42F 13/02

(52) U.S. Cl. ..... 402/8; 281/21.1; 281/45; 402/60; 462/75

(58) Field of Search ..... 281/15.1, 21.1, 281/23, 38, 28, 45; 402/79, 8, 60; 462/71, 75

(56) References Cited

U.S. PATENT DOCUMENTS

| | | | | | |
|---|---|---|---|---|---|
| 4,644,026 | A | * | 2/1987 | Shuman et al. | 524/270 |
| 4,657,960 | A | * | 4/1987 | Shuman et al. | 524/270 |
| 4,684,685 | A | * | 8/1987 | Shuman et al. | 524/270 |
| 5,169,254 | A | * | 12/1992 | Arkwright | 281/21.1 |
| 5,667,322 | A | * | 9/1997 | Mucznik | 402/8 |
| 5,810,498 | A | * | 9/1998 | Hirai | 402/8 |
| 5,873,601 | A | * | 2/1999 | Peleman | 281/21.1 |

* cited by examiner

*Primary Examiner*—A. L. Wellington
*Assistant Examiner*—Monica S. Carter
(74) *Attorney, Agent, or Firm*—Shlesinger Arkwright & Garvey LLP

(57) ABSTRACT

A fastening sheet assembly for attaching flat sheets to a backing panel has a releasable contact adhesive on its under-surface, and an integral disengaging member which is used to lift the low tack contact adhesive clear of the surface to which it is engaged.

26 Claims, 3 Drawing Sheets

ADHESIVE FASTENER ASSEMBLY

CROSS-REFERENCE TO RELATED APPLICATIONS

This application is a continuation in part of application Ser. No. 09/095,695 filed Jun. 11, 1998 now abandoned, which was a continuation-in-part of Ser. No. 08/521,538, filed Aug. 30, 1995 now abandoned, which was a continuation in part of application Ser. No. 08/162,875, filed Dec. 8, 1993 now abandonded which was a continuation in part of application Ser. No. 08/059,374, filed May 12, 1993 now abandonded, and also a continuation in part of application Ser. No. 08/099,458, filed Jul. 30, 1993, all abandoned. Application Ser. No. 08/521,538, filed Aug. 30, 1995, above, was also a continuation in part of application Ser. No. 08/389,677, filed Feb. 14, 1995 now abandonded, which was a continuation in part of application Ser. No. 08/174,325, filed Dec. 30, 1993 now abandonded, and was also a continuation in part of application Ser. No. 08/059,374, filed May 12, 1993 now abandonded, and a continuation in part of application Ser. No. 08/162,844, filed Dec. 7, 1993, all abandoned.

FIELD OF THE INVENTION

This invention is an improvement to the adhesive fastener used for file folders of the type shown in U.S. Pat. No. 5,169,254, dated Dec. 8, 1992.

This type of fastener is typically mounted in a conventional file folder on a prong fastener along the top edge of the file folder panel. The adhesive fastener pieces are hole punched and fit on the prong fasteners of the file folder. They are small rectangular pieces each of which has a contact adhesive on its undersurface which engages the top edge of a paper to be secured in the file to hold it in place. The adhesive on each adhesive fastener is covered by a release paper which is removed when the fastener is to engage a paper sheet inserted in the file. All of the fasteners are flexible pieces. The adhesive fasteners are successively connected to paper sheets as they are inserted in the folder starting with the lowermost fastener. All of the unconnected adhesive fasteners are bent upwardly to provide an opening under the lowermost unconnected adhesive fastener. The paper sheet is inserted in this opening and aligned in position on the panel with previously inserted papers.

Removal of the adhesive covering on the fastener immediately above this newly inserted paper sheet will permit the adhesive on that fastener to adhere to that paper sheet when the upwardly bent fasteners are released and a slight rub or press applies a downward pressure to adhere the fastener to the paper sheet.

This unique type of file folder fastener piece allows papers to be inserted more quickly, and eliminates the two-hole punch operation. The adhesive fasteners are constructed of clear, flexible, plastic material, and the adhesive is a reusable type, so that the pages may be quickly removed, copied, and replaced, without disturbing the other pages in the file. The fastener provides greater holding power than an ordinary paper that is two-hole punched. Tapes will not tear out of the file.

BACKGROUND AND SUMMARY OF THE INVENTION

During the course of development of the adhesive fastener for file folders, limitations in materials, adhesives, and arrangement of the component parts were encountered. The adhesive fastener configuration of this application is an outcome of such development efforts.

The specific type of fastener material, for example, is of specific interest with respect to how fastened papers of the file fold back over the file during use. The type of adhesive and the substrate are important with respect to consistent holding power of the fastener, and also ability to separate the adhesive of the fastener from an inserted paper sheet. The width of the contact adhesive and its positioning affect both movability of the fastener attached paper sheets and also affect the hinge action provided by the fastener.

The lower free section with this configuration also provides a lifting section which is sufficiently wide to be grasped between the fingers of the user to separate the adhesive fastener from the paper to which it is attached.

Although a strong bond is provided by the adhesive to the paper, the paper can be quickly removed by pulling up the fastener from the paper. This combination of strength and releasability is not achieved with the holding power of ordinary contact adhesives. Their bond is either too strong, so that one cannot remove the bonded pieces, or, as in the case of the adhesive notes, the bond has no holding power. It has been found that in the setting of a file folder, a relatively small mid-range of adhesive strengths of sufficient holding power provided in the transverse direction parallel to the attached papers, is sufficient. Yet, the lower holding power or tack, than strong bonding adhesives, will permit the separation of the fastener from the paper, when the fastener is pulled upwardly away from the surface of the paper. The strength of the adhesive in the selected range is also great enough to resist papers being pulled away from the fastener when papers are folded back over the top of the file folder.

Consequently, the adhesive fastener of this invention provides the capability to quickly place a paper in a file, to hold it more securely than ordinary two-hole punched papers, and yet permits the paper to also be quickly removed, if desired, and subsequently replaced in the file folder.

Additionally, the contact adhesive on the file fastener provides a flexible hinge connection for a paper, so that it can be readily folded back over the top of the folder without the spring back problem encountered with ordinary two-hole punched paper fastening devices. This is accomplished by spacing the contact adhesive a distance from the prong fasteners so that a hinge area is provided.

The filed paper positioned anywhere in the file folder is readily separated from the fastener without requiring dismantling of the other papers in the file. This is not possible with conventional prong fastener mounted papers in a file folder. The fastener is easily pulled free of the paper to which it is attached, and the paper simply removed. If desired to reinsert the paper subsequently, the paper is merely inserted under the fastener as previously. To do this, a marking paper is placed underneath the paper to be removed from the file, so that the adhesive will then engage that paper during the time that the removed paper is absent from the file. To replace, the removed paper is merely placed in position underneath the marking or holding paper, and the making paper is removed, leaving the contact adhesive of the fastener now free to reengage the top surface of the removed fastener, as before.

The removal of a paper is a very simple operation. The fastener is simply pulled free. The positioning of the contact adhesive remotely from the lower edge of the fastener. The lower free area permits the user to grasp it and pull the fastener upwardly, this construction feature permits handy and quick disengagement of the fastener.

It has also been found that disengagement of the fastener can be substantially speeded, without reducing the holding power of the fastener. Surprisingly, it has been found that a reduction of approximately 50 percent in the width of the adhesive will allow quicker disengagement, without adversely effecting the holding power of the fastener. Apparently, because the larger force is ordinarily required up along a line parallel to the paper surface of the adhesive, and when the upward force is exerted, or when papers are folded over, the holding force required is substantially less, although transverse to the bonded surfaces, therefore a reduced adhesive width is possible. Also the reduction in peeling time (removal) is substantial and there is a substantial reduction in cost, since tape is expensive.

Use of two sided adhesive tape also is a major advance in providing a more reliable fastener, and one that does not require complex manufacturing techniques. Attempted production of fasteners with direct application of adhesive to the fastener surface presented quality control problems, as well as problems. economical production techniques. Purchasable commercial tapes, having high tack holding power on one side, providing a permanent bond to the fastener, and a lower tack releasable adhesive within the limits desired, were found and provided reliability, as well as simplified manufacturing techniques. However, finding a commercial tape having the quality control and reliability within the limits needed was difficult but was eventually found.

These and other features and advantages of this adhesive fastener invention will become apparent to those skilled in the art when taken with respect to the following detailed description of the preferred device.

DESCRIPTION OF THE INVENTION

Figure 1:
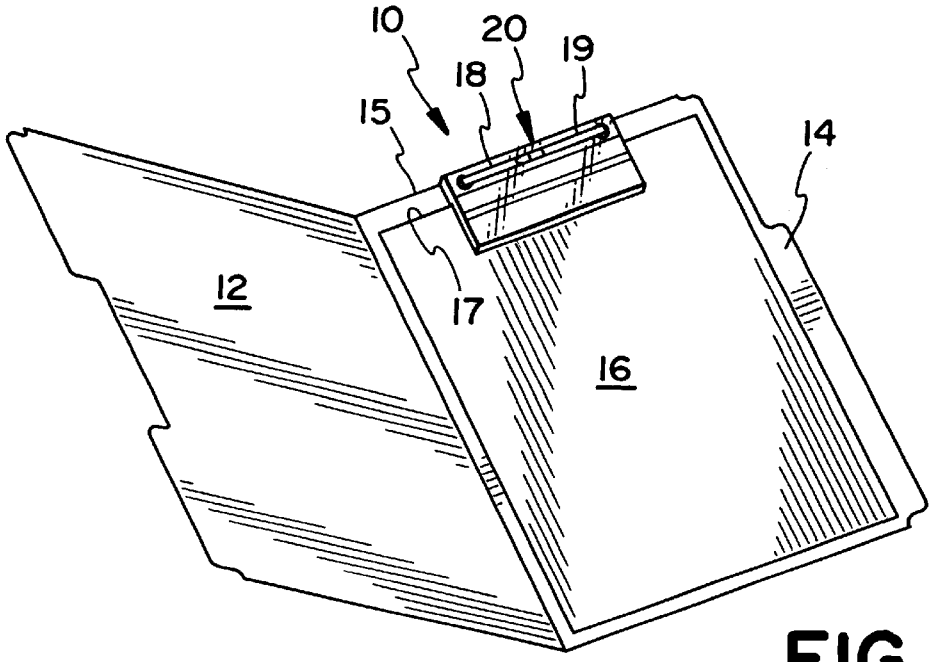
FIG. 1 is a perspective view of a file folder showing adhesive fasteners in position.
Figure 2:
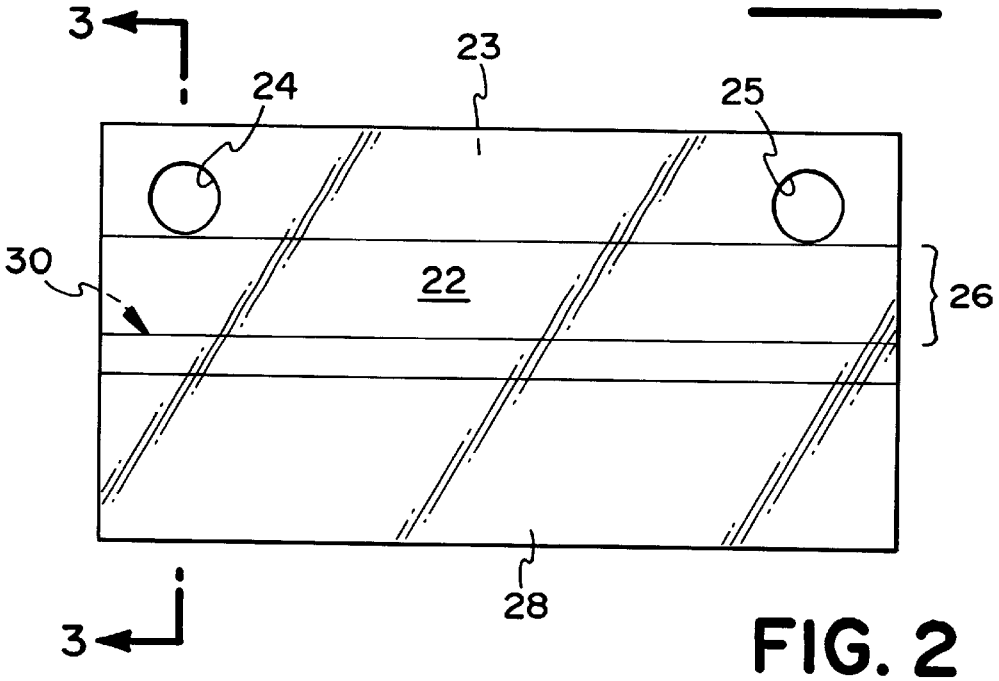
FIG. 2 is a plan view of the adhesive fastener of this invention.

Referring particularly to the drawings, FIG. 1 discloses a plan view of a manila type file folder generally indicated at 10 having panels 12 and 14 a paper 16 shown on panel 14 with its upper edge 17 adjacent to the upper edge 15 of panel 14. The securing prongs 18 and 19 of a prong type fastener mounted adjacent to the upper edge 15 are shown holding a plurality of adhesive fastener sheet generally indicated at 20 in position. FIG. 2 shows a plan view of the fastener sheet construction. The desired number of fastener sheets are placed on the prongs 18 and 19 to secure the paper sheet inserts in position in the file.

Figure 3:
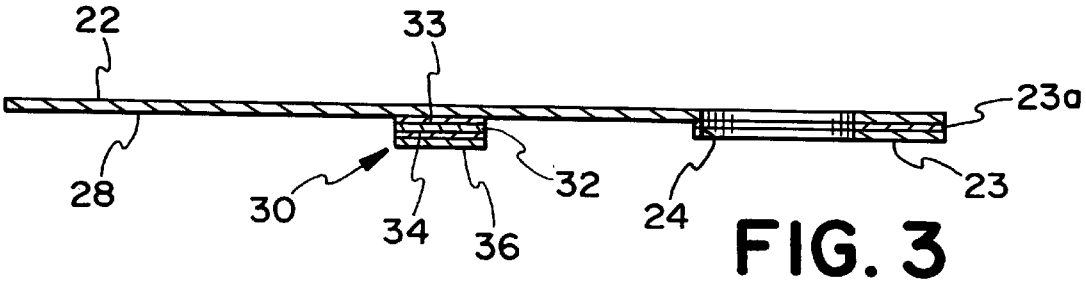
FIG. 3 is a sectional view along line 3—3 of FIG. 2.

The fastener sheet 22 shown in FIGS. 2 and 3 is a bendable flexible piece of polypropylene which is approximately three and one half inches long and one and one half inches wide. It is approximately two mils in thickness. A strip of reenforcing tape 23, one half inch wide, having an adhesive layer 23*a* is bonded to the underside of the longitudinally extending section of the fastener sheet provide strength around the punched holes 24 and 25 through which the prongs 18 and 19 are passed. The free area 26 is the hinge area which is five sixteenths inch wide and extends across adhesive fastener 22. It is separated from the free edge grasping section 28 by a double-sided adhesive tape generally indicated at 30, which is mounted on the underside of the fastener sheet element 22.

The adhesive fastening strip 30 is a double-sided adhesive contact coated tape 34 having a non-removable type permanent adhesive layer 33 on the top side and a reusable removable type adhesive on its lower surface. The reusable adhesive layer 34 is covered by a release paper 36 which has a coating of silicone or similar type of coating to permit it to be removed from the adhesive layer 32. The double coated tape 32 and the release covering paper strip 36 extend longitudinally across the entire length of the fastener piece 22 as shown in FIG. 2.

It has high tack, permanent type adhesive up to 45 ounce peel value on its upper surface which permanently bonds it to the under surface of the fastener. The other side of the tape has medium (10 to 14 ounce peel value) tack, removable, reuseable adhesive for removably engaging the surface of paper sheet insert.

When the fastener is to be used to hold a paper in position the release strip 36 is peeled from the adhesive layer 34 of the lower-most unused fastener piece in the file folder. This is done after all the unused fastener pieces above the last inserted paper sheet are bent upwardly about the hinge areas 26 to provide an opening up to the prongs 18 and 19. The paper sheet to be inserted, such as sheet 16 is then inserted into position under the lower-most fastener and aligned over the previously filed paper with the upper edge, such as edge 17 placed up against the prongs 18 and 19. The upwardly bent fasteners are then released, placing the exposed adhesive strip of the lower most fastener into contact with the upper surface of the inserted sheet to hold it in position in the file.

Figure 4:
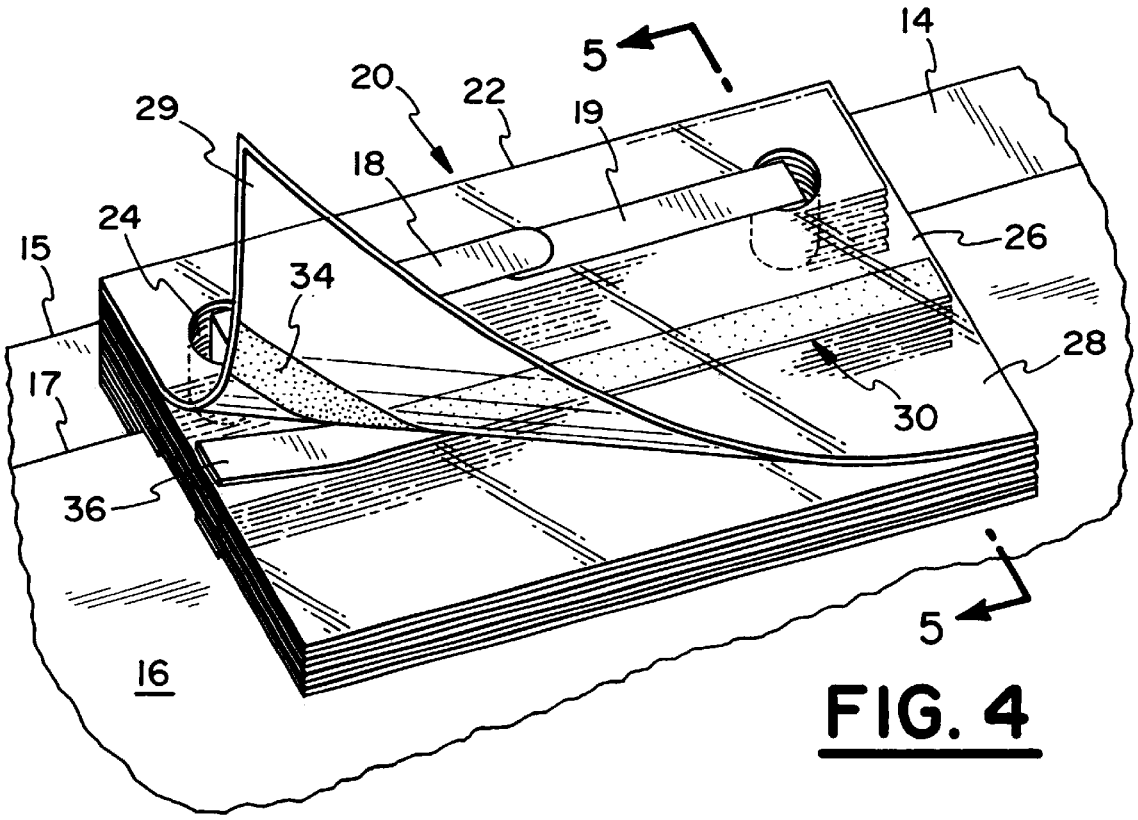
FIG. 4 is an enlarged perspective view of the adhesive fasteners of FIG. 1.

FIG. 4 is an enlarged perspective in view of the super posed fasteners generally indicated in 20, illustrated in the manner in which the paper sheet is held within the file. Of particular interest here, and for illustration purposes, the upper-most fastener sheet, in this case fastener sheet 22 has its lower right hand edge 29 bent upwardly to illustrate the simplicity of removal of the release cover paper strip 36 from the adhesive surface 34. The release paper cover strip 36 is readily separated from the fastener sheet 22 at the corner 29 when it is bent back as shown. The release strip 36 is thicker and more rigid then the fastener material 22, and therefore has a tendency to separate when the fastener edge 29 is bent backwardly. This permits the user to grasp the edge of the release paper cover strip 36 and easily remove it completely from the strip 34, without the need of a grasping tab. As mentioned previously, this is accomplished with the lower-most unattached fastener, which is the fastener above the last-used fastener. For example, in FIG. 5 which is a side view of FIG. 4, the next fastener used would be fastener 44.

Figure 5:
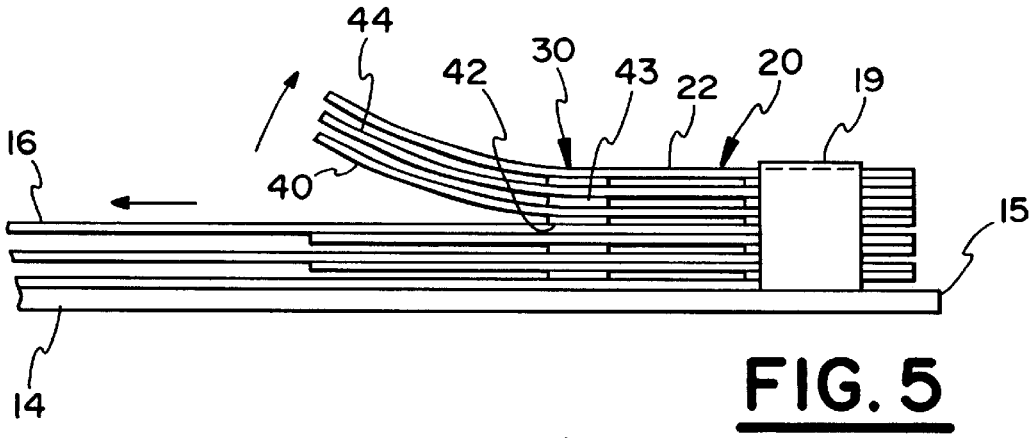
FIG. 5 is a cross-section of a view of FIG. 4.
Figure 6:
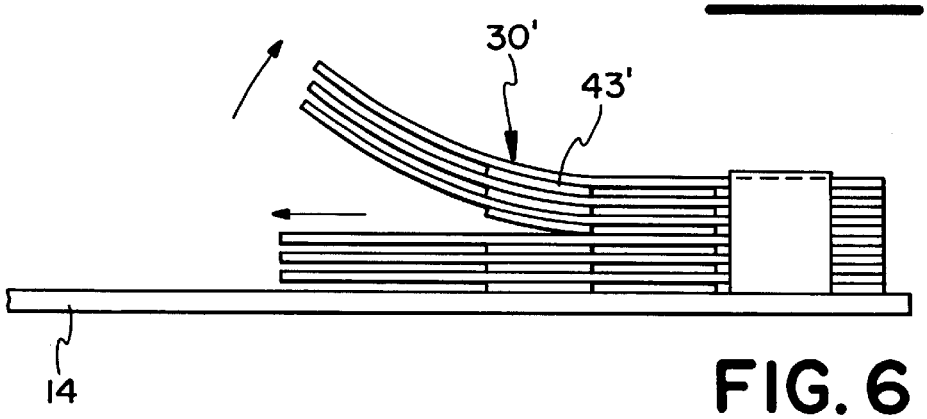
FIG. 6 is a cross-sectional view similar to FIG. 5 showing a prior contact adhesive construction.

FIG. 5 illustrates the removal of sheet 16. The fastener 40 is lifted up and its adhesive layer 42 is pulled up and away from the sheet 16 and thereby separated from the top surface of sheet 16 to completely remove it. The adhesive on the under surface of the two side coated tape, as mentioned previously, is a releasable adhesive, which is strong enough to hold the papers in position, but also has the property of releasing or separating from the paper when the fastener strip is pulled upwardly along its lower edge as indicated by the arrow. In this respect, it has been found that a substantially narrower strip approximately 5/32's of an inch in width (about half that of prior widths) is sufficient to adequately secure the papers in the file. Surprisingly, slightly reducing the width has very substantially reduced the amount of time required to pull the fastener strip free from the paper to which it has been attached. The previous width, which was slightly more than one quarter inch, is illustrated in FIG. 6 at 30' and 43'. Unexpectedly, the very narrow width of the adhesive strip provided both more than adequate holding strength, and simultaneously greatly reduced the peel time to remove the adhesive from an inserted paper. The time reduction is more than the fractional reduction in width, permitting the release to change from a slow steady peel, to a fast pull action.

Figures 7, 8, 9, 10:
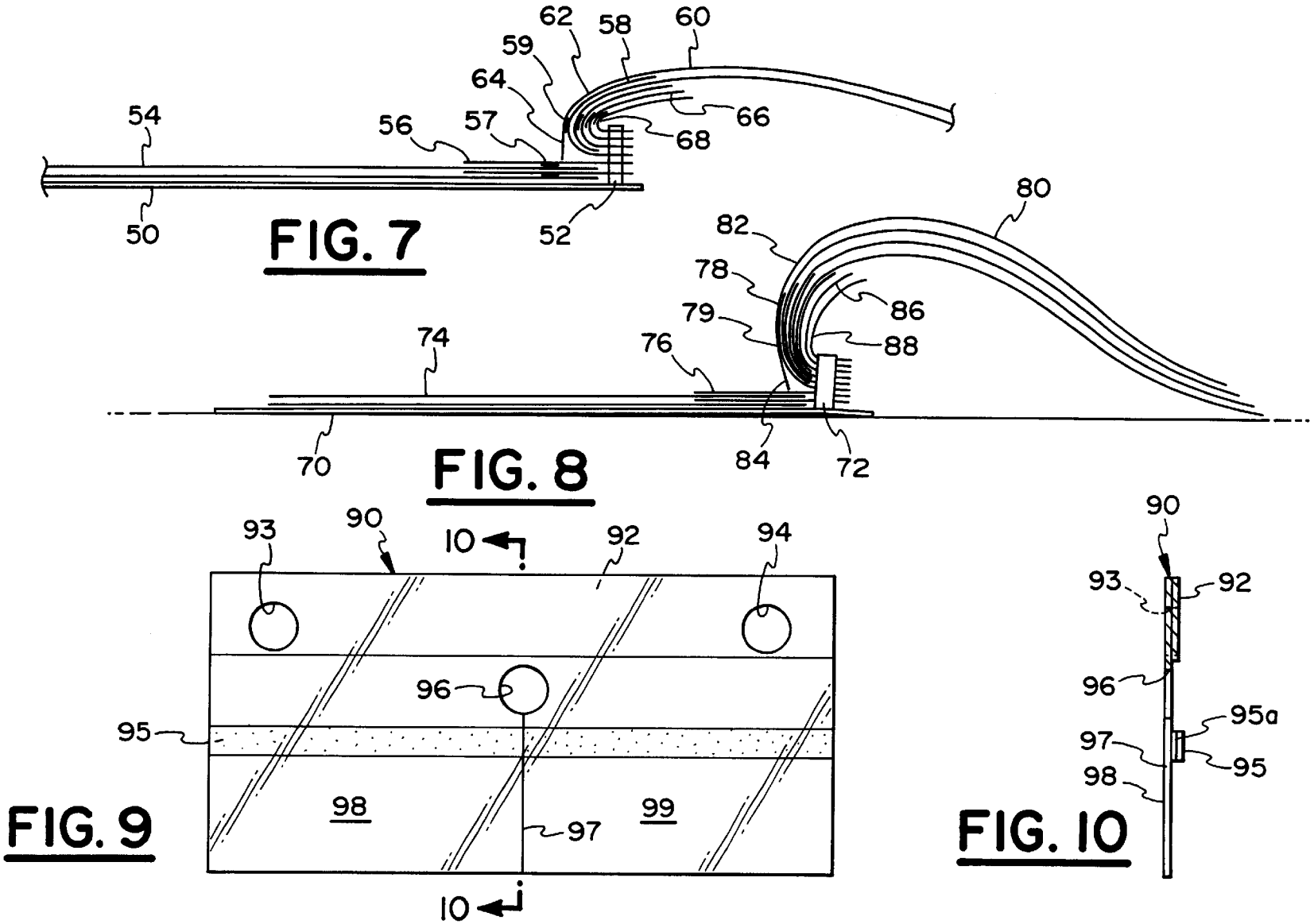
FIG. 7 is a side view of a file folder showing the manner in which the file sheets are folded back.
FIG. 8 is a side view of a file folder illustrating the manner in which the adhesive fasteners permit a file sheet to be folded back during use.
FIG. 9 is a plan view of another modification of adhesive fastener.
FIG. 10 is a cross sectional view along line 10—10 of FIG. 9.

FIGS. 7 and 8 illustrate the importance of the type of material used for the fastener 22 and its construction.

FIG. 7 is a side view of a folder assembly having a backing panel 50 and prong fastener 52 on which adhesive fasteners of the type described above are mounted. The sheet 54 is held in position by the adhesive fastener strip 57 on the under side of the fastener 56. In this particular configuration, the file user has opened the file to review paper 54. In doing so the papers above 54, specifically papers 60 are folded back over the top of the panel as conventionally practiced. It should be noted then when the upper papers are folded back in this fashion, the adhesive fasteners permit them to lay back over the file, and to remain in that position, without having the springing back tendency of two-hole punched fastened papers.

Note in FIG. 7, that the sheet 60 when bent back has a tendency for its bottom edge 64 to move outwardly and away from the adhesive strip 59 on fastener 58 which is holding it in position. This is brought about by the sharp bending radius at 62. The adhesive strength must be sufficient to resist separation. Note that the flexibility of the material of the upper most fasteners 66 permit a very sharp bend. This action takes place with the adhesive fastener material previously used, namely, polyethylene. It has been found that with the switch to the polypropylene material there is less bend. The difference in degree is considerable, since the polyethylene material thickness previously used was in the order of three to four mils. With the discovery that polypropylene material could be used, it was possible to eliminate the kick-out action of the piece 64, with a material that was only half as thick. The kick out action of the upper edge of the pieces was annoying, since it required the user to tuck the upper edge 64 back into position under fastener 58 before the papers could be returned to their original position in the file. It also had a greater separation affect of the adhesive strip.

FIG. 8 illustrates the manner in which the pages lay back when using the polypropylene material of fastener 22. The sheets are mounted on panel 70 with a top exposed sheet 74 held in position by the adhesive fastener 76. The fastener 78 is bent upwardly but does not bend over as do the fasteners of FIG. 7. This new fastener, and the other fasteners shown are more resistant to bending and have a tendency to bent upwardly to a more vertical position, as shown, without springing the paper back. The paper sheet 80 has a more gradual bend beyond the section 82 which is substantially upright. Note that the top section of 84 of sheet 80 does not come forward (kick out) and away from the prong 72. Its slight inclination toward the prong 72 permits the section 84 to automatically return to its original position in engagement with the prong, without requiring the file user to tuck it back. The upper adhesive fasteners 86 and 88 provide some support and resistance to bending.

FIG. 9 is a plan view of a multiple section adhesive fastener 90. FIG. 10 is a sectional view. Its general construction is similar to the fastener of FIGS. 2 and 3. The fastener 90 has an underlying reinforcing tape 92, and is two hole punched at 93 and 94 to permit it to be mounted on prong fasteners. The double sided tape 95 mounted on the under side of the fastener piece 90 is identical with the two side coated tape of FIGS. 2 and 3. It has (high tack—45 oz.) permanent type adhesive on its upper surface which permanently bonds it to the under surface of the fastener 90. The other side of the tape has the desired intermediate peel value range tack, removable, reusable adhesive for removably engaging the surface of paper sheet insert. While providing necessary holding power.

FIG. 10 is a cross sectional view of FIG. 9, along line 10—10 showing the reinforcing strip 92 in section, and an end view of the adhesive strip 95. In this regard, it should be noted that it is possible to directly apply an adhesive strip directly to the surface of the fastener. Presently, however, quality control and manufacturing cost are limitations. But, in that event, the construction would simply be an adhesive layer 95 directly applied to the fastener surface, and covered by a removable silicon-coated release strip 95*a*.

The economy of construction is a chief advantage of this configuration. But more importantly, the ease of attachment and release of a file paper, and its much greater flexibility were unexpected advantages. A hole 96 is made through the adhesive fastener 90 as shown. A connecting cut or slit 97 connects the lower free edge of fastener 90 to the hole 96. This results in a two-piece member having individual engaging sections 98 and 99. With this configuration, there is sufficient stability provided by each piece 98 and 99. As a result of the cut 97 one fastener piece can hold two different paper sheets, thereby doubling capacity of the fastener piece. Unexpectedly, an upward pull on the fastener lower section gives an immediate, quick release from the file paper rather than a peel release.

Polypropylene, which is the material used for adhesive fastener 90 has less tear resistance then polyethylene. This has been the reason for using the reinforcing tape pieces 23 and 93 of the modifications shown. The tendency to tear is also a problem when the adhesive fastener is to be cut, as at 97. It has been found necessary to end the cut line 97 in a pre-made opening 96 to avoid the tendency to tear.

With regard to the material used in the adhesive fastener, it has also been found preferable to provide a relatively rough surface having high surface tension at the maximum dyne level of 40 to 45 dynes. This will provide holding power between the permanent adhesive surface of a double coated tape and the under surface of the adhesive fastener 22. Polypropylene film is a clear material having a coefficient of friction of between 0.30 to 0.60, a stiffness "secant modulus" of 115, a yield strength of fifteen thousand square inch pounds.

The double coated adhesive tape has a polyvinyl chloride base which is approximately one mil thick. The adhesive is an acrylic adhesive. This is important, since it has been found that rubber based, and solvent based adhesives do not provide the necessary stability in the close range of 10–14 oz. peel value. A twelve ounce peel value is preferred. This provides holding strength without tending to peel, and yet to permit removal, the reusable adhesive coating must be of this type of adhesive. Too low a peel value will provide insufficient holding power to hold when file papers are folded back as shown in FIGS. 7 and 8, while too high a peel value will either take texture from the paper, or be non-removable. The peel value range must be accurately maintained generally between ten to fourteen ounce peel value. This required uniformity with good quality control, is the advantage of using a commercial tape product.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

I claim:

1. A fastener sheet assembly, comprising:

a) a flat backing panel on which file paper sheets are mounted;

b) a plurality of superposed thin, flexible, file fastener sheets securely mounted in a flap-like manner along their top longitudinal edge to the top edge of the central section of the backing panel;

c) a contact adhesive on the underside of each of the fastener sheets engaging and holding an upper portion of a paper sheet to be mounted on the backing panel;

d) the contact adhesive being spaced sufficiently from and below the top edge of each of the fastener sheets, to define a hinge section above the contact adhesive, and, also below it an adjacent outer free relatively wide and graspable disengaging section, which is pulled to disengage the contact adhesive of the fastener sheet from the paper sheet;

e) the width of the fastener hinge sections of the fastener sheets being sufficient to permit the fastening sheets to bend back so that paper sheets readily fold back over the backing panel; and f) the contact adhesive is a medium tack reusable type of adhesive whereby there is provided a sufficiently strong adhesive force to hold the paper sheet securely in the file and resists both a strong pull force exerted parallel to a paper sheet surface, and a transverse separation force exerted when the paper sheet is folded back, but which is weak enough to allow separation of the paper from the fastener sheet when the graspable disengaging section is pulled upwardly and away from the file sheet surface by the user.

2. The fastener sheet assembly as set forth in claim 1, wherein:

a) the contact adhesive is a narrow line of adhesive extending across the fastener sheet.

3. The fastener sheet assembly as set forth in claim 2, wherein:

a) the contact adhesive is disposed on a tape which has a layer of permanent high tack adhesive disposed between the tape and the surface of the fastener sheet in which it is in contact.

4. The fastener sheet assembly as set forth in claim 2, wherein:

a) the contact adhesive is an acrylic adhesive.

5. The fastener sheet assembly as set forth in claim 4, wherein:

a) the peel force is in the range of 10 to 14 ounces.

6. The fastener sheet assembly as set forth in claim 2, wherein:

a) the contact adhesive strip is a medium tack acrylic adhesive; and b) the width of the contact adhesive strip is less than one-quarter inch wide.

7. The fastener sheet assembly as set forth in claim 2, wherein:

a) the file fastener sheet is a clear flexible plastic piece of polypropylene.

8. The fastener sheet assembly as set forth in claim 7, wherein:

a) the fastener sheet is approximately two mils in thickness.

9. The fastener sheet assembly as set forth in claim 2, wherein:

a) the hinge section of the fastener sheets above the contact adhesive is approximately five-sixteenth inch wide.

10. The fastener sheet assembly as set forth in claim 1, wherein:

a) the top section of the fastener sheet above the hinge section has two punched holes to accommodate prongs of a prong fastener attached to the backing panel.

11. The fastener sheet assembly as set forth in claim 10, wherein:

a) the contact adhesive is a narrow line of adhesive extending across the fastener sheet.

12. The fastener sheet assembly as set forth in claim 11, wherein:

a) the fastener sheet is cut transversely at the mid-section of the fastener sheet to provide a multiple section sheet fastener sheet assembly.

13. The fastener sheet assembly as set forth in claim 12, wherein:

a) the contact adhesive is disposed on a tape which has a layer of permanent high tack adhesive disposed between the tape and the surface of the fastener sheet in which it is attached;

b) the contact adhesive peel force is in the range of 10 to 14 ounces;

c) the fastener sheet is approximately two mils in thickness.

14. The fastener sheet assembly as set forth in claim 1, wherein:

a) the contact adhesive is disposed on a tape which has a layer of permanent high tack adhesive disposed between the tape and the surface of the fastener sheet with which it is in contact;

b) the contact adhesive peel force is in the range of 10 to 14 ounces;

c) the fastener sheet is approximately two mils in thickness.

15. The fastening sheet assembly as set forth in claim 1, wherein:

a) the fastening sheet is cut transversely from its lower free edge across the free lower section and the mid-section to the top longitudinally extending section to make two separate but interconnected fastening sheet members.

16. The fastening sheet assembly as set forth in claim 15, wherein:

a) the contact adhesive has a narrow linear configuration and is located in the central section of the fastening sheet; and b) the contact adhesive has a peel force value of from 10 to 1.4 ounces.

17. The fastening sheet assembly as set forth in claim 16, wherein:

a) the contact adhesive is disposed on a linear extending double-stick tape integral with the fastening sheet.

18. A fastening sheet assembly, comprising:

a) a flat backing panel on which flat paper sheets are mounted;

b) a small, thin, flexible, fastening sheet for removably engaging a flat sheet to be mounted on the flat backing panel;

c) a supporting element connected with the top longitudinally extending section of the fastening sheet which supports the fastening sheet on the backing panel in a flap-like manner;

d) contact adhesive on the fastening sheet and in engagement with the upper section of a flat sheet;

e) the contact adhesive positioned on the fastening sheet below and spaced from the supporting element to engage and support the flat sheet, and to simultaneously allow bending of the fastening sheet;

f) at least a part of the lower fastening sheet below the contact adhesive being usable for grasping and lifting the fastening sheet to separate the contact adhesive from the flat sheet surface to which it has been engaged;

g) the contact adhesive is a medium tack reusable type of adhesive whereby a sufficiently strong adhesive force holds the paper sheet securely, resisting a strong pull force exerted parallel to the paper sheet surface, and a transverse separation force when the paper sheet is folded back, but, is weak enough to allow separation of the paper from the fastener sheet when the lower part of the fastening sheet is grasped and lifted upwardly and away from the flat sheet surface.

19. The fastening sheet assembly as set forth in claim 18, wherein:

a) fastening sheet is a polypropylene material having a thickness of approximately two mils.

20. The fastening sheer assembly as set forth in claim 19, wherein:

a) the contact adhesive has a narrow linear configuration and is located in the central section of the fastening sheet; and b) the contact adhesive has a peel force value of from 10 to 14 ounces.

21. The fastening sheet assembly as set forth in claim 20, wherein:

a) the contact adhesive is disposed on a linear extending double-stick tape integral with the fastening sheet.

22. The fastening sheet assembly as set forth in claim 18, wherein:

a) the contact adhesive is disposed in a relatively narrow section which extends parallel to the top longitudinal section of the fastening sheet.

23. The fastening sheet assembly as set forth in claim 22, wherein:

a) the width of the narrow section is approximately one quarter inch.

24. The fastening sheet assembly as set forth in claim 18, wherein:

a) the contact adhesive is an acrylic adhesive.

25. The fastening sheet assembly as set forth in claim 18, wherein:

a) the contact adhesive has a peel force range of 10 to 14 ounces.

26. The fastening sheet assembly as set forth in claim 18, wherein:

a) the space between the supporting element and the contact adhesive is at least approximately one quarter inch.

* * * * *